US008689755B2

(12) United States Patent
Schneider et al.

(10) Patent No.: US 8,689,755 B2
(45) Date of Patent: Apr. 8, 2014

(54) CAM AND ASSOCIATED CAMSHAFT

(75) Inventors: Falk Schneider, Korntal-Münchingen (DE); Antonio Menonna, Ditzingen (DE); Stefan Steichele, Gerlingen (DE)

(73) Assignee: Mahle International GmbH (DE)

( * ) Notice: Subject to any disclaimer, the term of this patent is extended or adjusted under 35 U.S.C. 154(b) by 309 days.

(21) Appl. No.: 13/166,014

(22) Filed: Jun. 22, 2011

(65) Prior Publication Data

US 2012/0000436 A1 Jan. 5, 2012

(30) Foreign Application Priority Data

Jun. 23, 2010 (DE) ..... 10 2010 024 721

(51) Int. Cl.
*F01L 1/04* (2006.01)

(52) U.S. Cl.
USPC ..... 123/90.6; 123/90.16; 29/888.1

(58) Field of Classification Search
USPC ..... 123/90.6, 90.16; 29/888.1
See application file for complete search history.

(56) References Cited

U.S. PATENT DOCUMENTS 7,434,572 B2 * 10/2008 Hutter et al. ..... 123/572

FOREIGN PATENT DOCUMENTS

| | | | |
|---|---|---|---|
| DE | 102006012611 | A1 | 9/2007 |
| FR | 749324 | A | 7/1933 |
| JP | 10-299426 | A | 11/1998 |
| JP | 10-299427 | A | 11/1998 |

OTHER PUBLICATIONS

English abstract for JP10-229426, Nov. 10, 1998.
English JP10-299427, Nov. 10, 1998.

* cited by examiner

*Primary Examiner* — Ching Chang
(74) *Attorney, Agent, or Firm* — Rader, Fishman & Grauer PLLC

(57) ABSTRACT

A cam for a camshaft of an internal combustion engine may include an axial extension with a holding contour for receiving a holding tool.

20 Claims, 1 Drawing Sheet

CAM AND ASSOCIATED CAMSHAFT

CROSS-REFERENCES TO RELATED APPLICATION

This application claims priority to German patent application DE 10 2010 024 721.9 filed on Jun. 23, 2010, which is hereby incorporated by reference in its entirety.

TECHNICAL FIELD

The present invention relates to a cam for a camshaft. The invention further relates to a camshaft equipped with at least one such cam.

BACKGROUND

Cams and camshafts are well known in connection with internal combustion engines and serve for controlling intake valves and exhaust valves of the internal combustion engines. Such camshafts are usually driven via the crankshaft which, for example, is drivingly connected by means of a chain to a sprocket on the camshaft. In order to fix the sprocket or the drive gearwheel on the camshaft, the camshaft has to be held with a high holding torque. Usual cams of a camshaft are not able to transmit said holding torques to the camshaft because, for example, already at a torque to be transmitted of more than 50 Nm between camshaft and normal cams, a slipping of the cam on the camshaft takes place. Thus, for applying the required holding torque, usually a holding contour, for example a dihedron, is provided or a plug which is inserted in the longitudinal end side and can be brought in operative connection with a holding tool. However, all known holding tools or holding contours implemented on the camshaft are costly or complicated.

SUMMARY

Thus, the present invention is concerned with the problem to propose for a cam or, respectively, for a camshaft of the generic type, an improved or at least an alternative embodiment which allows in particular a simplified fixation of a sprocket or, respectively, a drive gearwheel on the camshaft.

This problem is solved according to the invention by the subject matters of the independent claims. Advantageous embodiments are subject matter of the dependent claims.

The present invention is based on the general idea to increase a torque to be transmitted between a cam and an associated camshaft and, at the same time, to provide the cam with a holding contour so that during tightening a drive gearwheel or a sprocket on the camshaft, the respective cam can be used via its holding contour as abutment. For this purpose, the cam according to the invention has an axial extension provided with a holding contour suitable for a holding tool. Via said axial extension, a contact surface between the camshaft and the cam is enlarged so that it is also possible to transmit an increased torque between the camshaft and the cam. With the axial extension according to the invention it is possible, for example, to transmit torques between the cam and the camshaft of approximately 230 Nm which corresponds approximately to four times the previously usual transmittable torque. Counter-holding the camshaft via the holding contour of the cam according to the invention allows a significantly simplified mounting of the drive gearwheel on the camshaft, wherein in particular plugs on the longitudinal end side and holding tools to be brought in operative connection thereto can be eliminated.

In a particular advantageous development of the solution according to the invention, the holding contour is formed as hexagon. Such a hexagon can be gripped and held by conventional screw wrenches, whereby the mounting of the drive gearwheel or the sprocket and in particular tightening the same on the camshaft is simplified. In general, it is not necessary to finish-machine all surfaces of the hexagon but, for example, only two opposing surfaces at which holding the camshaft during the assembly of the drive gearwheel takes place.

Advantageously, two cams are connected to each other via an axial extension arranged therebetween. With such an embodiment, the torque transmittable from the cam to the camshaft can be increased again because the contact surface between the twin cam and the camshaft and associated therewith, the friction occurring here can be considerably increased.

Further important features and advantages of the invention arise from the sub-claims, from the drawings, and from the associated description of the figures based on the drawings.

It is to be understood that the above mentioned features and the features yet to be explained hereinafter can be used not only in the respectively mentioned combination but also in other combinations or alone without departing from the context of the present invention.

Preferred exemplary embodiments of the invention are illustrated in the drawings and are explained in the following description in more detail, wherein identical reference numbers refer to identical, or similar, or functionally identical components.

In the figures, schematically:

DETAILED DESCRIPTION

Figure 1:
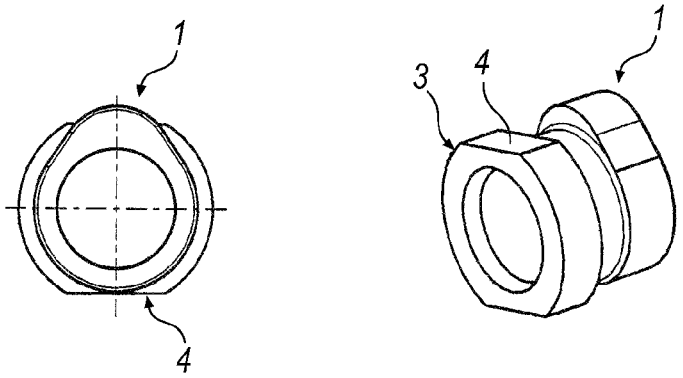
FIG. 1 shows a cam according to the invention in an axial view and an oblique view.
Figure 4:
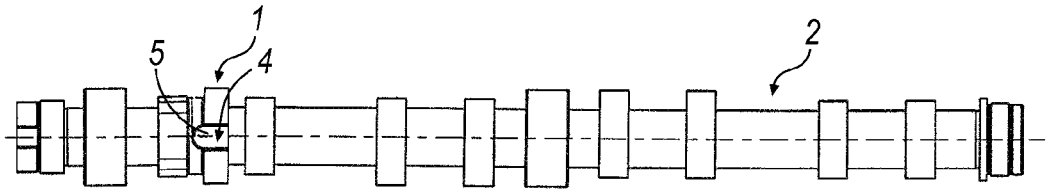
FIG. 4 shows a camshaft with an inventive cam according to FIG. 3.

According to FIG. 1, the cam 1 according to the invention for a camshaft 2 (cf. FIG. 4) has an axial extension 3 having a holding contour 4 suitable for a non-shown holding tool. Via this holding contour 4 which, according to FIG. 1, is formed as dihedron, high torques or holding torques can be exerted or introduced to the camshaft 2, which torques are in particular required during the fixing, that is during tightening a drive gearwheel. Up to now, said holding torques had to be applied by means of a dihedron directly arranged on the camshaft 2 or via a plug inserted in the end side of the camshaft 2. Through the axial extension 3, a contact surface between the cam 1 according to the invention and the camshaft 2 is enlarged so that there is an increased friction between the two components 1 and 2 which allows the transmission of significantly increased torques of, for example, 230 Nm.

Figure 2:
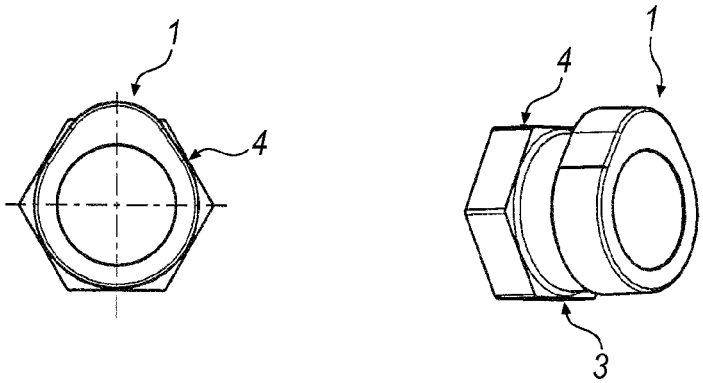
FIG. 2 shows an illustration as in FIG. 1 but with a cam having a different holding contour.
Figure 3:
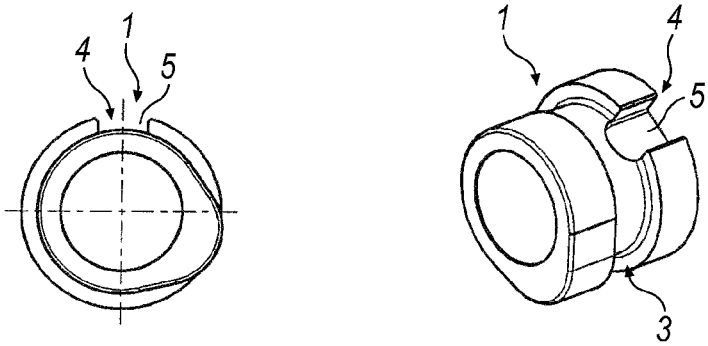
FIG. 3 shows an illustration as in FIG. 1, but with a further alternative embodiment of the holding contour.

When viewing FIGS. 2 and 3 it is apparent that, for example according to FIG. 2, the holding contour 4 is formed as hexagon whereas according to FIG. 3, it is formed as groove 5.

The axial extension 3 which also comprises the holding contour 4 can be made in one piece with the cam 1 or can be integrally formed, in particular forged thereon. It is also conceivable that two cams 1 are connected to each other via an interposed axial extension 3 so that a one-piece twin cam with a central axial extension 3 is created via which even higher torques can be transmitted to the camshaft 2.

Machining the holding contour 4, that is for example the hexagon or dihedron, is only required if the same are actually needed for applying a holding torque or for aligning. In general, one cam 1 according to the invention per camshaft 2 is sufficient for applying the holding torque required for fixing the drive gearwheel.

Thus, with the cam 1 according to the invention it is possible to transmit the holding torque required for fixing the drive gearwheel exclusively via the cam 1 according to the invention to the camshaft 2 so that further tools or plugs with adequate holding contours are no longer required, which makes mounting the drive gearwheel onto the camshaft 2 easier and also reduces the manufacturing costs of the camshaft 2 according to the invention.

The invention claimed is:

1. A cam for a camshaft of an internal combustion engine having an axial extension with a holding contour for receiving a holding tool, the holding tool configured to hold the camshaft in response to high torques applied to the camshaft while tightening a drive gearwheel on the camshaft.

2. The cam according to claim 1, wherein the holding contour is formed as a dihedron.

3. The cam according to claim 2, wherein the axial extension is integrally forged on the cam.

4. The cam according to claim 2, further comprising another cam, wherein the cams are connected to each other via an interposed axial extension.

5. The cam according to claim 2, wherein the cam and the axial extension are formed as one piece.

6. The cam according to claim 1, wherein the holding contour is formed as a hexagon.

7. The cam according to claim 6, wherein the axial extension is integrally forged on the cam.

8. The cam according to claim 6, further comprising another cam, wherein the cams are connected to each other via an interposed axial extension.

9. The cam according to claim 6, wherein the cam and the axial extension are formed as one piece.

10. The cam according to claim 1, wherein the holding contour is formed as a groove.

11. The cam according to claim 1, wherein the axial extension is integrally forged on the cam.

12. The cam according to claim 1, further comprising another cam, wherein the cams are connected to each other via an interposed axial extension.

13. The cam according to claim 1, wherein the cam and the axial extension are formed as one piece.

14. A camshaft having at least one cam, wherein the cam has an axial extension with a holding contour for receiving a holding tool, the holding tool configured to hold the camshaft in response to high torques applied to the camshaft while tightening a drive gearwheel on the camshaft.

15. The cam according to claim 14, wherein the holding contour is formed as a dihedron.

16. The cam according to claim 14, wherein the holding contour is formed as a hexagon.

17. The cam according to claim 14, wherein the holding contour is formed as a groove.

18. The cam according to claim 14, wherein the axial extension is integrally forged on the cam.

19. The cam according to claim 14, further comprising another cam, wherein the cams are connected to each other via an interposed axial extension.

20. The cam according to claim 14, wherein the cam and the axial extension are formed as one piece.

* * * * *